US011141643B2

(12) United States Patent
Petigorsky

(10) Patent No.: US 11,141,643 B2
(45) Date of Patent: Oct. 12, 2021

(54) TRAINING APPARATUS FOR FENCING

(71) Applicant: Miroslav Petigorsky, Herzeliya (IL)

(72) Inventor: Miroslav Petigorsky, Herzeliya (IL)

( * ) Notice: Subject to any disclaimer, the term of this patent is extended or adjusted under 35 U.S.C. 154(b) by 0 days.

(21) Appl. No.: 16/275,360

(22) Filed: Feb. 14, 2019

(65) Prior Publication Data

US 2019/0247731 A1 Aug. 15, 2019

Related U.S. Application Data

(60) Provisional application No. 62/630,282, filed on Feb. 14, 2018.

(51) Int. Cl.

| | |
|---|---|
| ***A63B 69/02*** | (2006.01) |
| ***A63B 69/34*** | (2006.01) |
| ***A63B 71/06*** | (2006.01) |
| ***A63B 69/00*** | (2006.01) |
| *A63B 24/00* | (2006.01) |
| *A63B 22/00* | (2006.01) |

(52) U.S. Cl.

CPC ..... *A63B 69/02* (2013.01); *A63B 69/0053* (2013.01); *A63B 69/34* (2013.01); *A63B 71/0622* (2013.01); *A63B 71/0669* (2013.01); *A63B 22/0002* (2013.01); *A63B 2022/0092* (2013.01); *A63B 2024/0068* (2013.01); *A63B 2220/56* (2013.01); *A63B 2220/58* (2013.01); *A63B 2220/62* (2013.01); *A63B 2220/833* (2013.01); *A63B 2225/20* (2013.01); *A63B 2225/50* (2013.01)

(58) Field of Classification Search

CPC ..... A63B 22/0002; A63B 2022/0092; A63B 69/325; A63B 69/02; A63B 69/0053; A63B 69/34; A63B 71/0622; A63B 71/0669; A63B 2024/0068; A63B 2220/56; A63B 2220/62; A63B 2220/58; A63B 2220/833; A63B 2225/205

See application file for complete search history.

(56) References Cited

U.S. PATENT DOCUMENTS

| | | | | | |
|---|---|---|---|---|---|
| 3,128,097 | A * | 4/1964 | La Rocca | A63B 69/02 | 463/47.1 |
| 3,576,323 | A * | 4/1971 | Pellicer | A63B 69/02 | 463/47.1 |
| 3,599,975 | A * | 8/1971 | Pellicer | A63B 69/02 | 463/47.1 |
| 5,700,230 | A * | 12/1997 | Cardona | A63B 69/34 | 482/83 |
| 7,527,568 | B2 * | 5/2009 | Joseph | A63B 69/345 | 473/422 |
| 9,427,648 | B2 * | 8/2016 | Cingone | A63B 69/0053 | |
| 9,789,375 | B2 * | 10/2017 | Salerno | A63B 69/004 | |

(Continued)

*Primary Examiner* — Megan Anderson

(74) *Attorney, Agent, or Firm* — Mark M. Friedman

(57) ABSTRACT

A training apparatus for fencing, the training apparatus including: (a) a movement mechanism having an extended state and a retracted state, the movement mechanism adapted to be coupled to a support structure on a first end thereof; (b) a target platform, the target operationally coupled to a second end of the movement mechanism; and (c) a computing component, the computing component electronically coupled to the movement mechanism and configured to control movement of the movement mechanism between the extended state and the retracted state.

20 Claims, 8 Drawing Sheets

(56) References Cited

U.S. PATENT DOCUMENTS

| | | | | |
|---|---|---|---|---|
| 9,821,208 | B2 * | 11/2017 | Hall | A63B 21/008 |
| 2004/0248633 | A1 * | 12/2004 | Trawick | A63B 69/34<br>463/8 |
| 2010/0292033 | A1 * | 11/2010 | Sarver | A63B 63/00<br>473/431 |
| 2014/0213418 | A1 * | 7/2014 | Lewicki | A63B 69/34<br>482/12 |

* cited by examiner

TRAINING APPARATUS FOR FENCING

This patent application claims priority from, and the benefit of, U. S. Provisional Patent Application No. 62/630,282, filed Feb. 14, 2018, which is incorporated in its entirety as if fully set forth herein.

FIELD OF THE INVENTION

The present invention relates to an automated training apparatus and, more particularly, to a training apparatus for the sport of fencing.

BACKGROUND OF THE INVENTION

When training for the sport of fencing, one of the activities is to do drills for blocking and stabbing with sparring partners. Another exemplary drill is to keep a necessary distance from the opponent, to be out of their attack zone. These exercises need a sparring partner, which limits the amount of training an individual can do when he is dependent on a partner. Other training apparatuses include wall-mounted padded boards, sometimes with circles on them or stationary dummies. Both the boards and dummies allow the trainee to practice on a static target. However, much of fencing is footwork and depth perception—moving towards and striking at targets that are also moving towards and away from the trainee.

SUMMARY OF THE INVENTION

The present invention successfully addresses the shortcomings of the presently known configurations by providing a moving target with adjustable arm for practicing with a target that moves away from, and towards, the trainee.

According to the present invention there is provided a training apparatus for fencing, the training apparatus including: (a) a movement mechanism having an extended state and a retracted state, the movement mechanism adapted to be coupled to a support structure on a first end thereof; (b) a target platform, the target operationally coupled to a second end of the movement mechanism; and (c) a computing component, the computing component electronically coupled to the movement mechanism and configured to control movement of the movement mechanism between the extended state and the retracted state.

According to further features in preferred embodiments of the invention described below the movement mechanism includes a reversibly extendable member and a linear actuator, the linear actuator effecting movement of the reversibly extendable member between the extended state and the retracted state. According to still further features in the described preferred embodiments the reversibly extendable member is a double trellis arrangement. According to further features, the linear actuator includes a ball screw and motor.

According to further features, the target platform includes a board and at least one sensor pad mounted on the board. According to further features, the at least one sensor pad senses a touch by a weapon, the sensor pad electronically coupled to the computing component which is configured to receive sensor values from the sensor pad. According to further features, the computing component configured to be in wireless communication with a remote device, the remote device including computer-readable instructions for performing statistical computations on the sensor values received from the computing component, and for displaying statistical information on the remote device, the statistical information resulting from the statistical computations.

According to further features, movement of the movement mechanism is configured to be remotely programmable and remotely controllable by a remote device in wireless communication with the computing component.

According to further features, the training apparatus further includes: (d) a mechanical arm operationally coupled to the target platform, the mechanical arm coupled to a weapon. According to further features, the mechanical arm includes a shoulder portion and a forearm, the shoulder portion rotationally coupled to the target platform and the forearm hingedly coupled to the shoulder portion.

According to further features, the mechanical arm is adapted to be manually manipulated. According to further features, the mechanical arm is adapted to be automatically manipulated. According to further features, the mechanical arm is automatically manipulated by an electrically automated actuator assembly electronically coupled to the computing component, the assembly including a series of gears, actuated by motors.

According to further features, the movement mechanism and the mechanical arm are configured to be remotely programmable and remotely controllable by a remote device in wireless communication with the computing component.

According to further features, the training apparatus further including sensor pads operationally coupled to the target platform and the mechanical arm, the sensor pads electronically coupled to the computing component.

According to further features, the training apparatus further includes a dummy operationally coupled to the target platform. According to further features, the dummy includes at least a head, torso and leg. According to further features, the training apparatus further includes at least one additional sensor pad operationally coupled to at least one of the dummy and the mechanical arm, the at least one sensor pad electronically coupled to the computing component.

According to further features, the movement mechanism and the mechanical arm are configured to be remotely programmable and remotely controllable by a remote device in wireless communication with the computing component.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

The principles and operation of a fencing training apparatus according to the present invention may be better understood with reference to the drawings and the accompanying description.

A training apparatus of the instant innovation is comprised of two main parts: a movement mechanism and a target platform. The training apparatus provides a moving target that alternatively approaches and moves away from the opponent. The movement mechanism extends and contracts, moving the target platform towards or away from the trainee. The trainee (opponent) practices advancing on, and/or retreating from, the moving target. The trainee can also practice lunging/stabbing at the target platform. In some embodiment, a weapon is mounted on the target platform. In such embodiments, the trainee further practices blocking the weapon while advancing, attacking or retreating.

Four exemplary embodiments of the target platform are discussed in detail below. The first embodiment discussed is a front board mounted on the moving mechanism. The second embodiment discussed further includes an arm mounted on the front board which is adapted to be manually manipulated. A weapon is attached to the end of the arm. The third embodiment discussed below includes an arm mounted on the target platform which is adapted to be automatically manipulated. The forth embodiment includes a partial dummy mounted on the front board. The dummy includes an arm holding a weapon.

Figure 1:
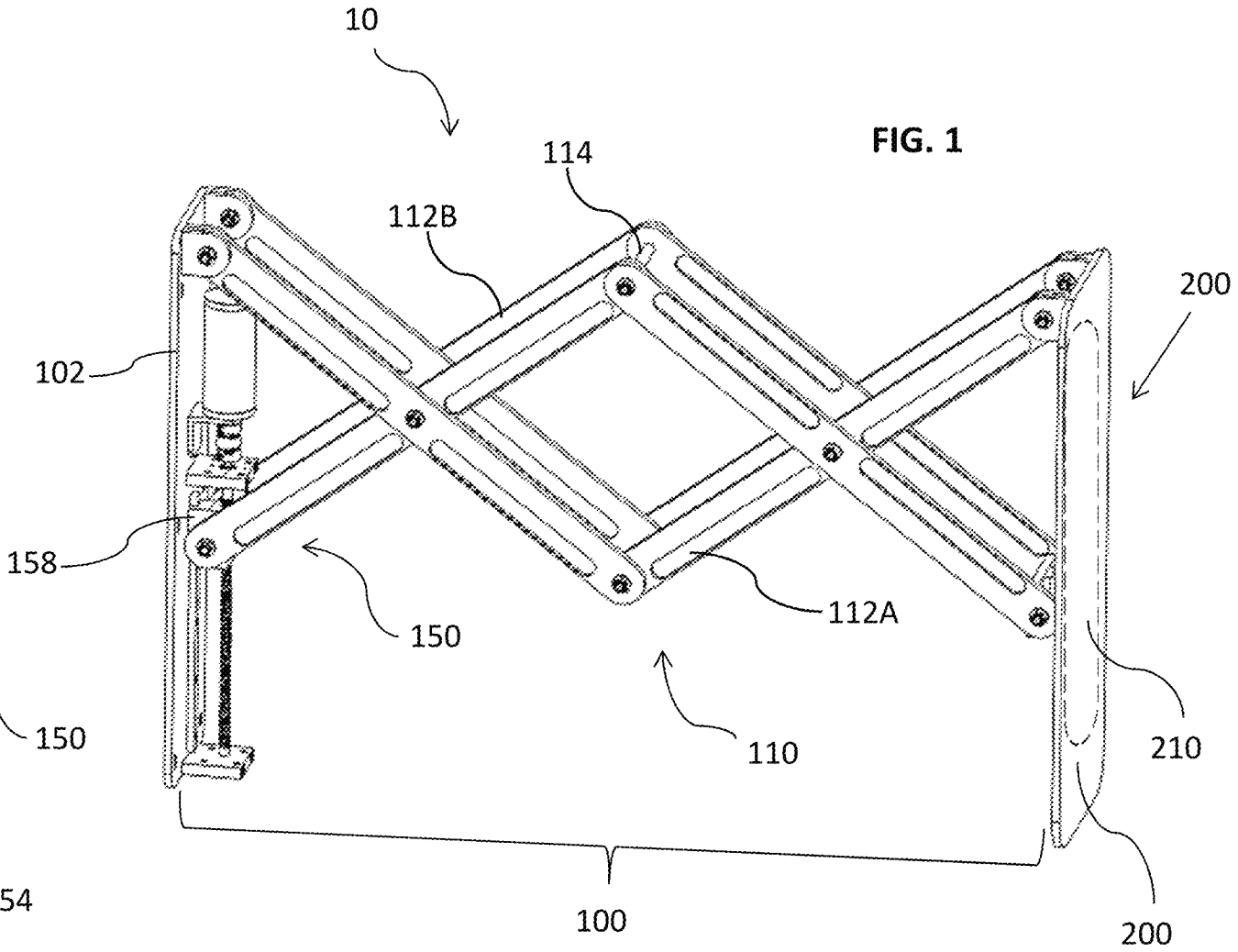
FIG. 1 is a side view of a first embodiment of a training apparatus 10 of the invention, in an extended state.
Figure 2:
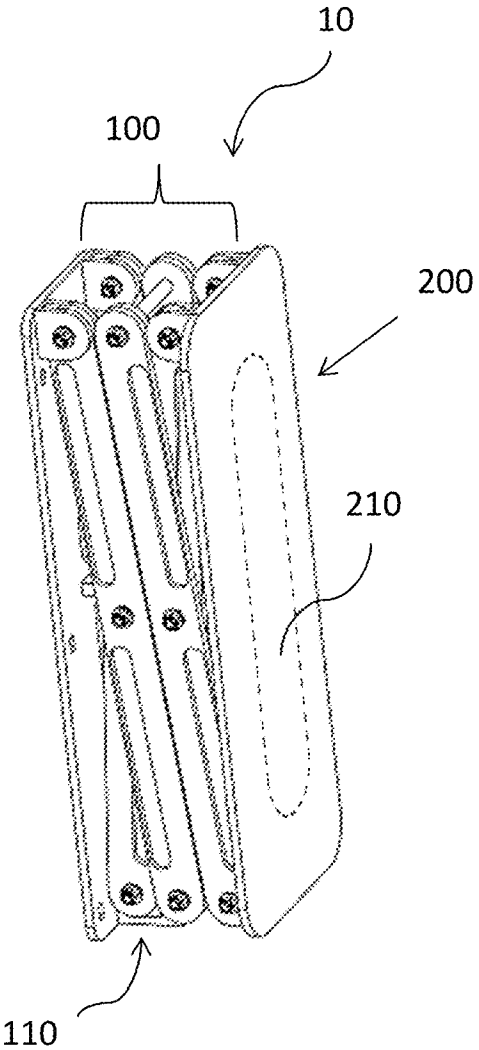
FIG. 2 is a a side view of the training apparatus 10 in a retracted state.

Referring now to the drawings, FIG. 1 illustrates a side view of a first embodiment of a training apparatus 10 of the invention, in an extended state. The training apparatus 10 includes a movement mechanism 100 and a target platform 200. FIG. 2 illustrates a side view of the training apparatus 10 in a retracted state.

It is made clear that any structural or functional description that is provided for one embodiment of the invention is intended to apply to all the other embodiments, as if fully described for each embodiment. Only if a given functional or structural feature is incompatible with one or more alternative configurations, it is clear that the incompatible feature is not considered part of the embodiment with which is it incompatible.

The movement mechanism is adapted to be coupled to a support structure on a first end and has an extended state and a retracted state. The movement mechanism 100 is made up of an extendable and retractable member 110 and a linear actuator 150. The linear actuator effects the movement of the extendable and retractable member (also referred to herein as a reversibly extendable member) between an extended state and a retracted state. A first end of the reversibly extendable member 110 is coupled to a support. A second end of the reversibly extendable member is operationally coupled to the target platform 200.

An exemplary embodiment of the movement mechanism is depicted in the Figures. Movement mechanism 100 includes the reversibly extendable member and actuator. In the exemplary embodiment, the reversibly extendable member is a collapsible assembly 110 that is formed from a double trellis (latticework) arrangement. Trellises 112A and 112B are spaced apart, and pivotally connected, by crossbars 114 (only one of which is visible in the Figures). A linear actuator 150 controls the movement of the trellis arrangement 110. The exemplarily linear actuator depicted in the figures is a rolled ball screw 150 actuated by a motor 160.

Figure 1A:
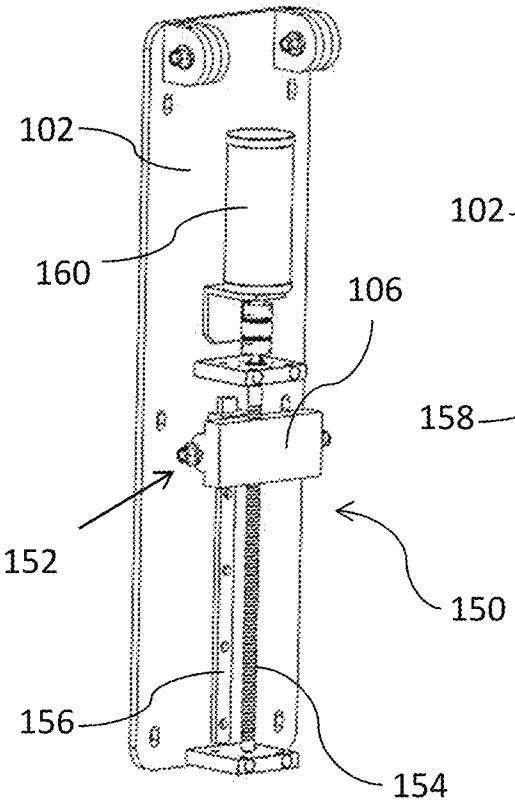
FIG. 1A is an isometric view of the ball screw 150 in a raised position.
Figure 2A:
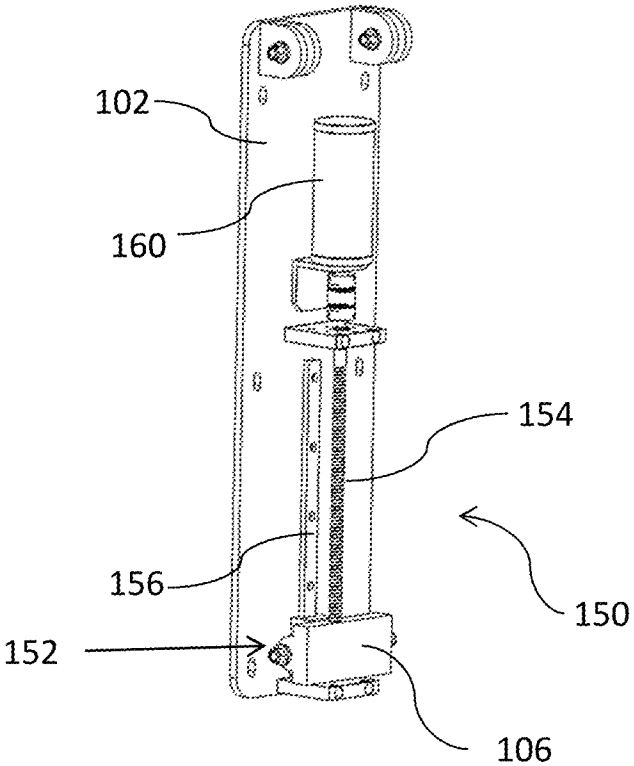
FIG. 2A is an isometric view of the ball screw 150 in a lowered position

FIG. 1A is an isometric view of the ball screw 150 in a raised position. FIG. 2A is an isometric view of the ball screw 150 in a lowered position. A ball assembly 152 (not visible) is positioned behind a coupling plate 106. The ball assembly 152 of the ball screw 150 is mechanically coupled to one end of the trellis assembly by the coupling plate 106. The ball screw moves the trellis from an open, extended state (FIG. 1) to a closed, retracted state (FIG. 2) by moving the ball assembly (which acts as the nut) from the upper position (depicted in FIG. 1A) on a threaded shaft 154 (the screw) to a lower position (depicted in FIG. 2A). When the ball assembly is in the upper position (FIG. 1A), the trellis assembly/reversibly extendable member 110/movement mechanism 100 is in an open, extended state, with the target platform 200 moved towards the trainee. When the ball assembly is in the lower position (FIG. 1B), the trellis assembly, reversibly extendable member 110/movement mechanism 100 is in a closed, retracted state, with the target platform 200 moved away from the trainee. The depicted, but exemplary, ball screw 150 is a Rolled Ball Screw, model BTK 1405.

The ball assembly also runs on a linear bearing guide which includes a rail 156 and a block 158 (seen better in FIG. 1) which stabilizes the movement mechanism and provides low friction, smooth, accurate motion for nearly any moment or normal loading condition. A motor 160 actuates the rolled ball screw 150. The motor is electrically actuated, and connected to the power mains. An exemplary motor used in tests was a 57 mm Brushless DC Motor 180 W 36V.

A back frame 102 is mechanically coupled to the movement mechanism. The back frame provides support for the entire training apparatus 10. Therefore the back frame needs to be mounted on a wall, pillar or any sturdy member that is solidly fixed to the ground and has the requisite height. Alternatively, a free-standing support with sufficient weight on the base of the support member can be used in place of a wall or pillar. A free-standing support is advantageous, at least, in that the back frame does not need to be permanently attached to a wall (e.g. by drilling screws into the wall), and consequently the free-standing support can be moved from place to place, and not tied down to a single location.

It is made clear that all the components, while preferred, are merely exemplary. The rolled ball screw can be substituted with any type of mechanical, lateral actuator. The motor/actuator may be battery powered or powered by the electricity grid. Any type of actuator and/or assembly that provides the forward-backward movement of the front board is considered to be within the scope of the invention. For example, an assembly of springs that facilitate the movement of the trellis and hence the backwards and forwards movement of the platform. Such a spring assembly biases the platform into the extended position and when the user pushes or stabs the platform and it moves backwards and forwards and backwards and forwards under the momentum of the initial push, restoring force of the spring(s), the weight of the platform and/or any subsequent hits by the user.

Likewise, the double trellis assembly may be replaced with any suitable substitute that expands and contracts/collapses, as relevant. For example, a pneumatic or hydraulic piston can be used in place of the trellis assembly. In another example, the movement mechanism is a motorized telescopic arm that is electronically actuated to reversibly extend and retract. In either of the aforementioned examples, and with other implementations not mentioned here, the non-moving end of the mechanism is fixedly attached to a wall or pillar etc. or to a free-standing support structure, while the moving end has a target platform attached thereto.

The target platform 200 is exemplarily embodied in a board mounted on (fixedly attached to) the second, or front, end of the movement mechanism 100. The board serves as the target that the trainee practices on. The board of the target platform 200 can be covered and/or padded (not shown). One or more senor pads, such as pressure sensitive pad 210, can be mounted on the target platform 200 to track the trainee's touches on the target with the weapon. The sensor pad(s) 210 serves a similar purpose to the lame worn by participants in fencing bouts. The lame is an electrically conductive jacket worn by foil and sabre fencers in order to define the scoring area and register touches by the weapon. In the instant embodiment, the board is representative of the torso, for trainees practicing with a foil, or the torso and head for trainees practicing with a sabre. The sensor pad(s) can additionally measure pressure, to register the force of the attack. The sensor pad 210 is indicated by a broken line on the board of the target platform.

While only indicated in FIGS. 1 and 2, it is made clear that the sensor pad 210 is an optional feature for all the embodiments. As mentioned elsewhere, this is true for all features that are disclosed for at least one embodiment. Furthermore, more than one sensor pad can be employed in the apparatus. For example, for embodiments with an arm and weapon and/or a dummy, many sensor pads can be positioned in various places which server as targets in a fencing bout.

The size and shape of the front board may vary or be modified. For example, the board may be longer to include lower sections of the body which can be attacked in some of the fencing disciplines (whereas in other disciplines only the upper body is legal target). Alternatively or additionally, the front board may be formed as a torso or similar form, to make a more lifelike target. A convex target may provide a more realistic practice tool with a smaller and more nuanced target area.

A computing component 300 is electronically coupled to the movement mechanism 100 and includes a processing unit for controlling the movement of the movement mechanism. In embodiments, the linear actuator is programmable and can be programmed to simulate erratic or unpredictable forward—backward movement (towards and away from the trainee). In all embodiments, the actuator can be remotely programmable and/or remotely controlled. A companion application 370 can be installed on a computing device such as a laptop or smart phone 320. The application can be used to create a program or control movement of the training apparatus in real time by sending instructions to the processing unit. Likewise, the location and pressure of the hits/touches sensed by the pressure sensor(s) can be stored on the microcontroller and/or on the remote computing device.

Figure 3:
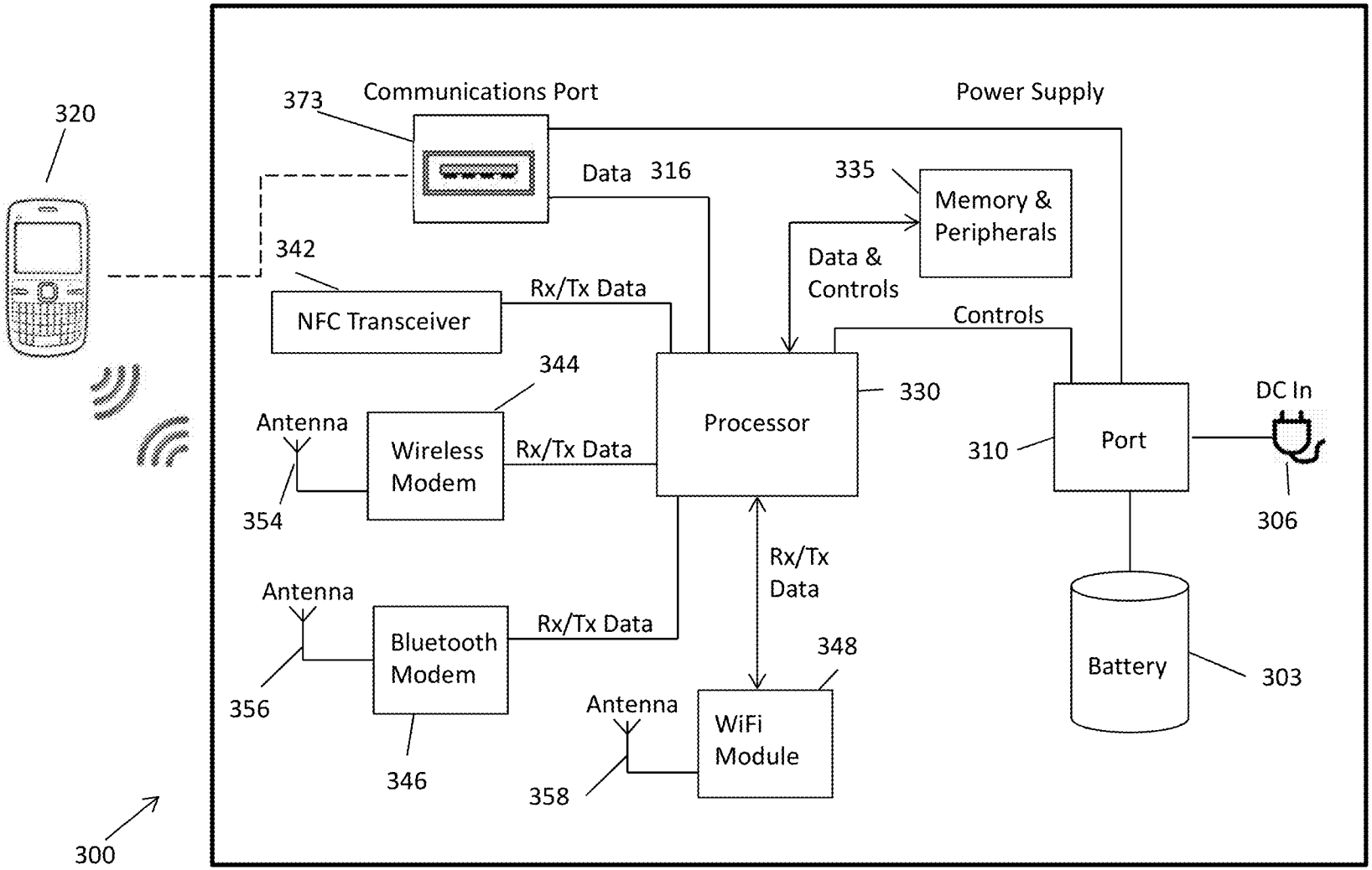
FIG. 3 is a block diagram illustrating circuitry of an exemplary computing component 300 of the training apparatus 10.

FIG. 3 is a block diagram illustrating circuitry of an exemplary computing component 300 of the training apparatus 10 according to some embodiments. The computing component may be physically integrated into the apparatus or may be a separate device. The computing component is wiredly/electronically coupled to the motor or motors (in embodiments with more than one motor, as described below) and sensor pad or pads, if such as or are included in the apparatus. In embodiments including a weapon (detailed below), the weapon may be adapted to register touch from the trainee's weapon. In such embodiments, the computing component is further wiredly coupled to the weapon.

Computing component 300 can be powered by a battery 303 and/or an external power source 306, both of which are connectable to a port 310, which might simply be a hardwire, or might include a selective connector. In case battery 303 is a rechargeable battery, external power source 306 may be used to recharge battery 303.

One or more electrical connectors 316 are used for exchanging information between components of the training apparatus 10 and at least one processor 330. For example, electrical connector 316 may be a USB cable that supports data-transfer rates of 480 Mbps to transmit and receive data streams. The processing unit 330 receives sensor data from the sensor pad(s) and/or weapon (if present) and sends instructions to the motor or motors via electrical connectors 316. The instructions may originate from preconfigured programming and/or instructions received from a remote device (e.g. smart phone 320). In a different configuration, electrical connector 316 may be connected to a communication port 373. Multiple leads (not shown) from the various components of the training apparatus are coupled to communication port 373. The communication port is in turn electrically coupled to at least one processor 330 via the electrical connector 316.

In some embodiments, apparatus 300 includes at least one processor (e.g., processor 330). The term "processor" as used herein refers to any physical device having an electric circuit that performs a logic operation on input or inputs. For example, processor 330 may include one or more integrated circuits, microchips, microcontrollers, microprocessors, all or part of a central processing unit (CPU), graphics processing unit (GPU), digital signal processor (DSP), field-programmable gate array (FPGA) or other circuits suitable for executing instructions or performing logic operations. Processor 330 may be configured to communicate with motors and sensor pad(s) of the training apparatus as well as with other electronic components (e.g., a transceiver) within the computing component and to control at least one of the components of the apparatus. The instructions executed by processor 330 may be pre-loaded into a memory unit integrated with embedded into processor 330, or stored in a separate memory unit 335 having an erasable and non-erasable memory banks, such as a RAM, a ROM, or a hard disk. In the alternative, the instructions executed by processor 330 may be received from a remote device in wireless communication with the computing component. For example the remote device is a mobile device 320, i.e., mobile device 320 or an application pre-installed on the mobile device can control the operation of the processor 330 by sending processor 330 instructions via one of the apparatus' auxiliary wireless transceivers or via electrical connector 316.

In the example illustrated in FIG. 3, processor 330 is connected to four transceivers (342, 344, 346, and 348). Transceiver 342 may be a Near Field Communication (NFC) transceiver dedicated to communicating with mobile device 320. For example, transceiver 342 may receive a data stream or a portion of a data stream from mobile device 320. Transceiver 344 may be a cellular transceiver for communicating with at least one cellular network. Transceiver 346 may be a Bluetooth transceiver for communicating with any mobile/portable device such as mobile device 320, a laptop or tablet computer etc. having Bluetooth technology. Transceiver 348 may be a WiFi transceiver for communicating with any device providing Internet access over a wireless local area network. Transceivers 344, 346, and 348 may be respectively associated with antennas 354, 356, and 358.

Figure 4B:
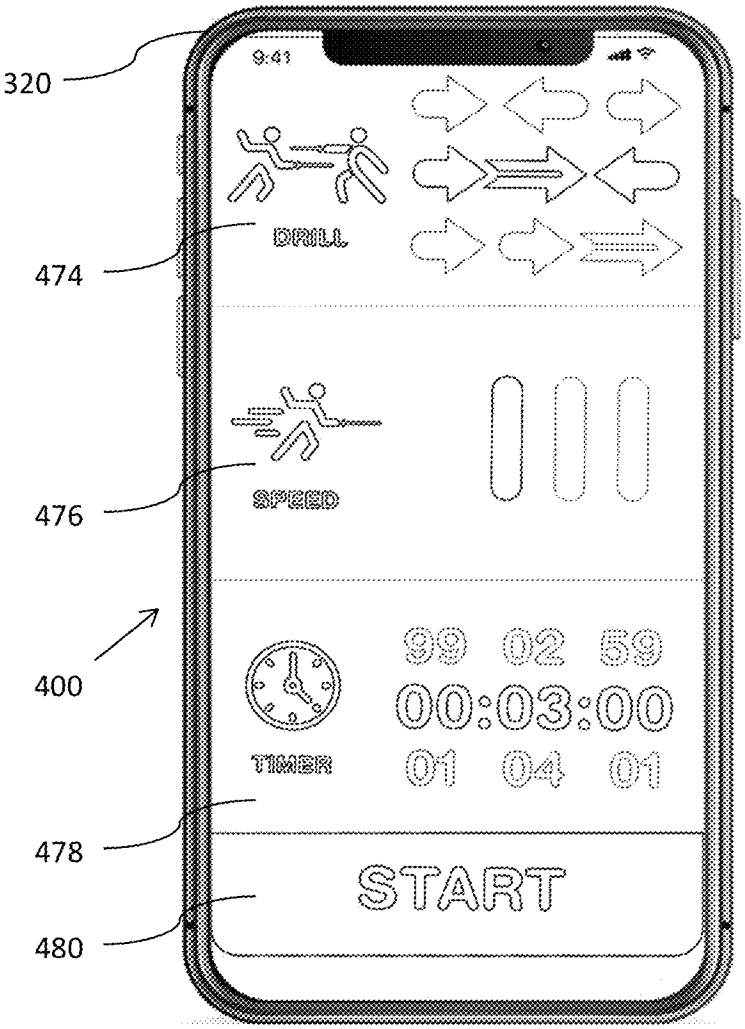
FIGS. 4A and 4B are screen shots of mobile application.
Figure 4A:
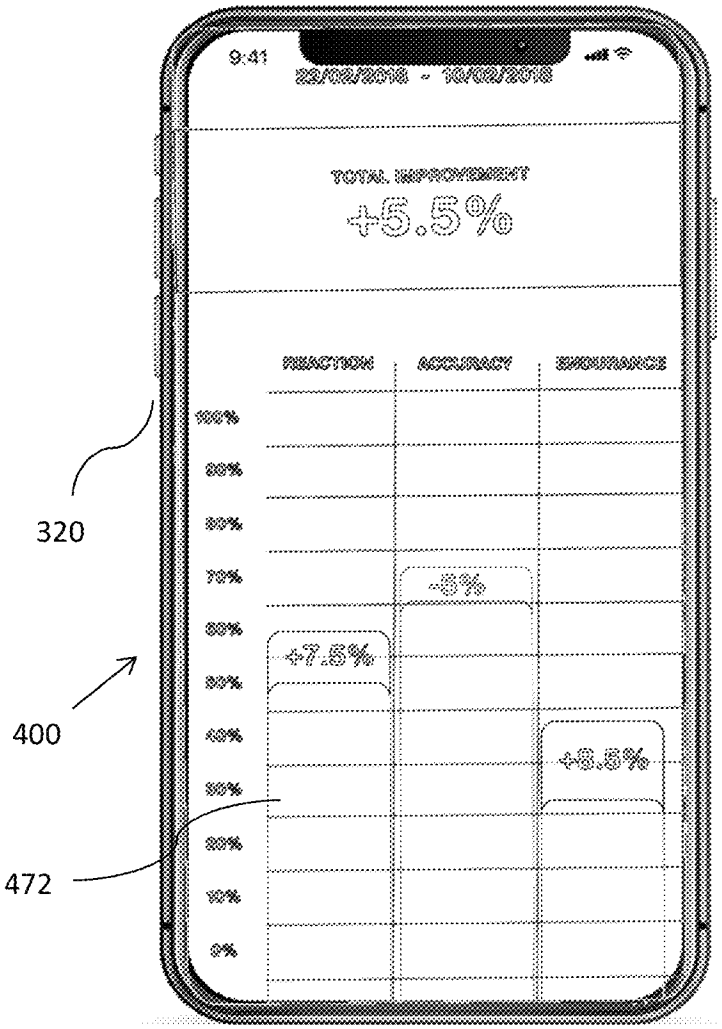

FIG. 4A is a screen shot of an exemplary screen 472 of a mobile application (app) 400 which is in wireless electronic communication with the training apparatus 10. Sensor pad 210 and/or additional sensors on the target platform 200 sense where the fencing weapon touches the target, how quick the reaction time is and how accurate the thrust is. The app receives the values from the processing unit of the training apparatus (via a wireless component in electric communication with the processing unit). The computer logic residing in the app calculates various statistics which are then displayed on the screen of the mobile device. Said differently, the computing component 300 is configured to be in wireless communication with a remote device, where the remote device includes computer-readable instructions for performing statistical computations on the sensor values received from the computing component, and for displaying statistical information on the remote device. The statistical information is the result of the statistical computations.

The sensor values received over time are computed into statistics for various parameters. Exemplarily, the screen capture of FIG. 4A displays a screen of statistics 472 taken over a period of 12 days and displays a visual representation of reaction time, accuracy and endurance. For each training session, the app compares the telemetry from the current training session to previously stored statistical data and indicates improvement or regression relative to the historical data. The trainee can immediately see what areas need improvement and what areas have improved. The app can also build a training program for the trainee based on the statistical information. The training program is custom built to improve the specific trainee's performance.

Of course, the aforementioned functionality is not limited to a mobile app, and can be implemented on any type of computing device with the necessary computer components. Alternatively or additionally, the processing unit on the training apparatus can both receive the sensor data and calculate the various statistics and other output. The output can be communicated in a wired manner to a user display coupled to the training apparatus, or wirelessly to a remote computing device as discussed above.

FIG. 4B is a screen capture of a training program control screen of the companion app 400. The exemplary control screen is divided into three sections. The top section 474 is the drill selection section. The user can select one of three drills in the exemplary screen. The middle section 476 is the speed selection section. The user can select one of three speeds, one bar being the slowest and three bars being the fastest.

The bottom section is a timer section 478. The duration of the training section is preset by selecting hours, minutes and seconds. A "start" button 480 sends instructions to the training apparatus to start the training session which has been defined via the user interface of the control screen. The selected drill will commence at the selected speed for the selected amount of time. The depicted features are merely exemplary and additional or different features may be available via the app or other computer application/software. For example, a custom-made drill, as discussed above, may be available for selection. In a further example, each movement of the training apparatus may be controlled remotely, like controlling an avatar in a video game. A trainer can manipulate the training apparatus while standing off to the side in order to see how the trainee performs in different situations.

As mentioned above, the computing and control components described above are not limited to the instant embodiment and configuration of the invention, but rather apply, mutatis mutandis to all the embodiments disclosed herein. Accordingly, other embodiments which include an arm and hand have corresponding control and computing features for manipulating the arm and/or hand holding a weapon.

Figure 5B:
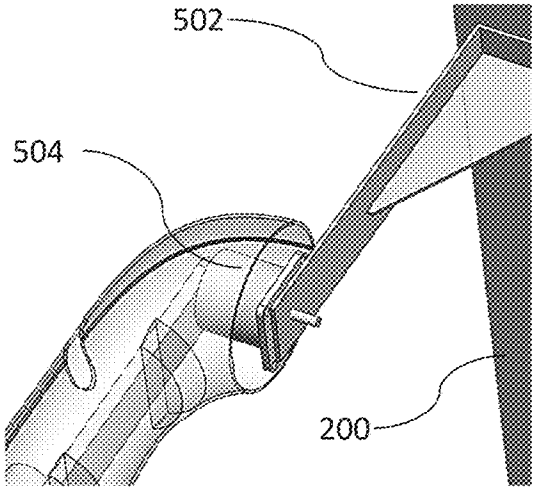
FIG. 5A-C are partial illustrations of training apparatus 20.
Figure 5C:
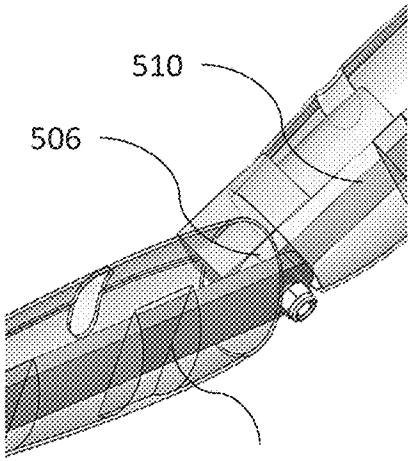
Figure 5:
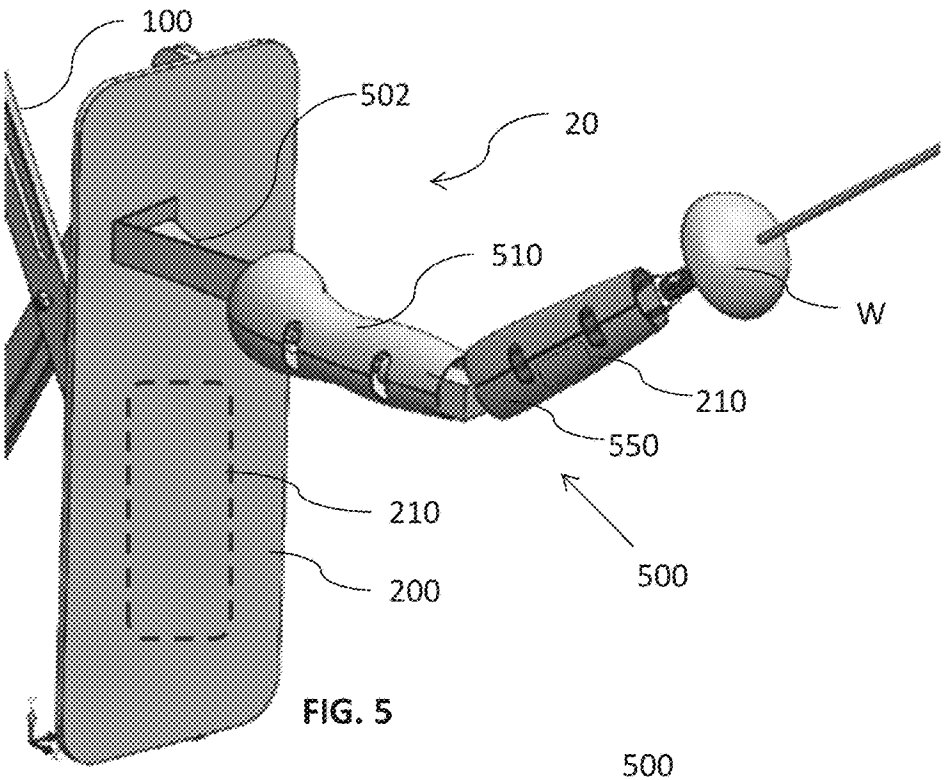
FIG. 5 is a partial view of a training apparatus 20, in an extended state.

Another possible configuration is shown in FIG. 5. FIG. 5 depicts a partial view of a training apparatus 20, in an extended state. Training apparatus 20 has the same movement mechanism 100, target platform 200 and computing component 300 (as well as optionally companion application 400) as training apparatus 10. As such (as mentioned above), the entire description provided for training apparatus 10 applies equally mutatis mutandis to training apparatus 20, and is considered as if fully set forth here. In addition to all the components and optional features described above, training apparatus 20 further includes a mechanical arm 500 which comprises a shoulder portion 510 and a forearm or forearm portion 550. The shoulder portion is rotationally coupled to the target platform 200 and the forearm is hingedly coupled to the shoulder portion. A fencing weapon W is attached to the forearm 550.

Figure 5A:
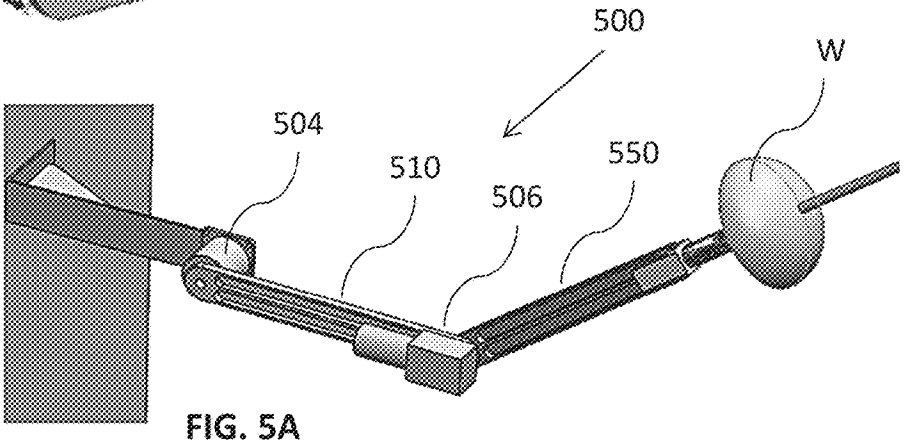

FIG. 5A is a partial illustration of training apparatus 20, with the outer shell pieces of the arm 500 removed. FIG. 5B is a partial illustration of training apparatus 20, with the shell piece of the shoulder portion 510 made transparent. FIG. 5C is a partial view of training apparatus 20 with the shell pieces of the shoulder portion 510 and forearm 550 made transparent.

According to the instant embodiment, arm 500 is adapted to be manually manipulated. The arm 500 is mechanically coupled to the target platform 200 by a bracket 502. Shoulder portion 510 is rotationally coupled to bracket 502 via a rotational coupling 504, giving the shoulder portion a freedom of movement defining an arc of approximately 180 degrees. The shoulder portion, on the distal end, is mechanically coupled to the forearm 550 via a hinge 506. The shoulder portion and forearm need to be manually manipulated into a set position in which they will stay until manually fixed into a new position.

Figure 6A:
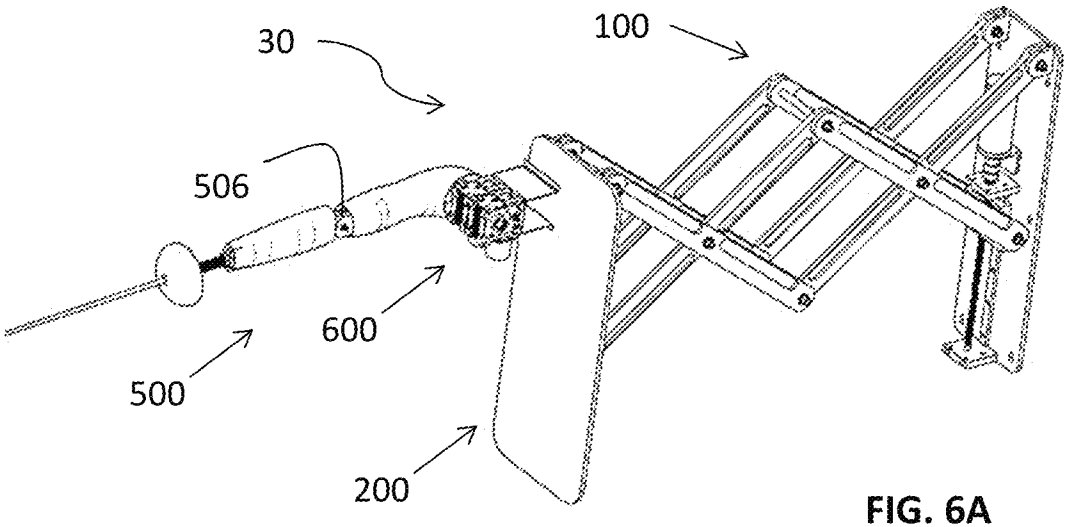
FIG. 6A is a training apparatus 30 in an open, extended state.
Figure 6B:
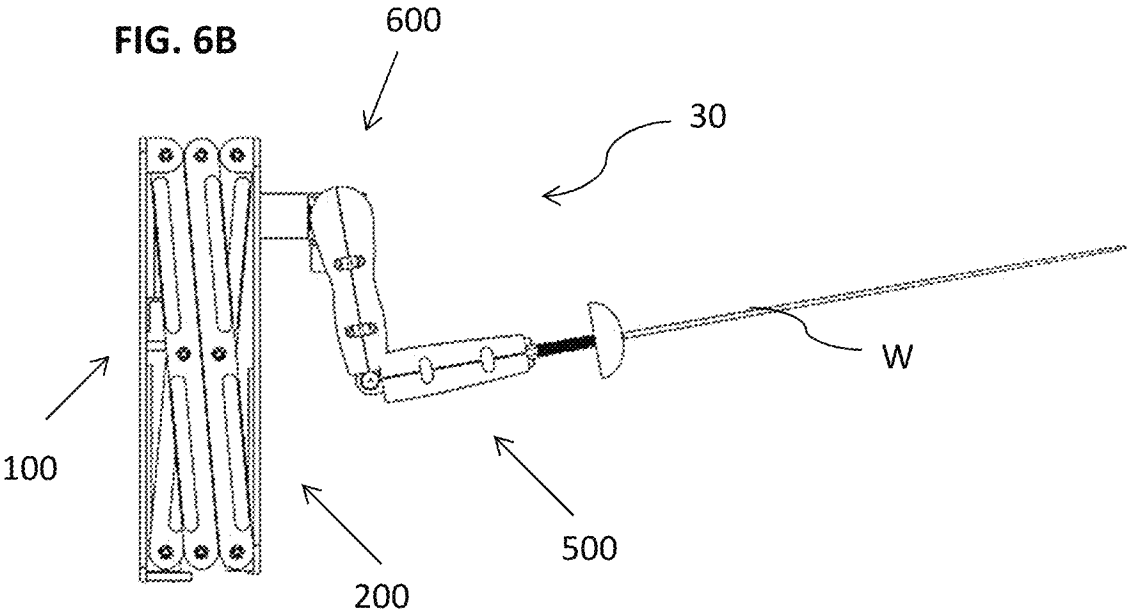
FIG. 6B is the training apparatus 30 in a closed, retracted state.
Figure 6D:
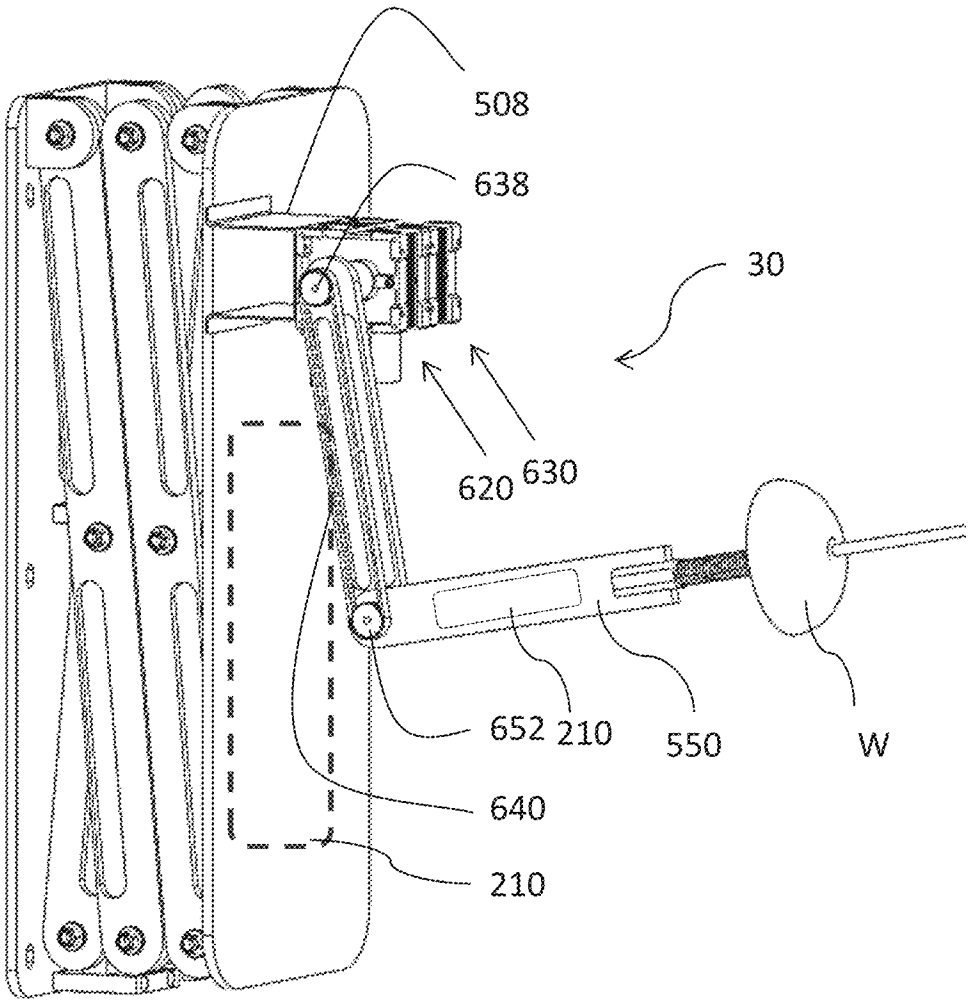
FIG. 6D is a side view of the apparatus of FIG. 6C.
Figure 6C:
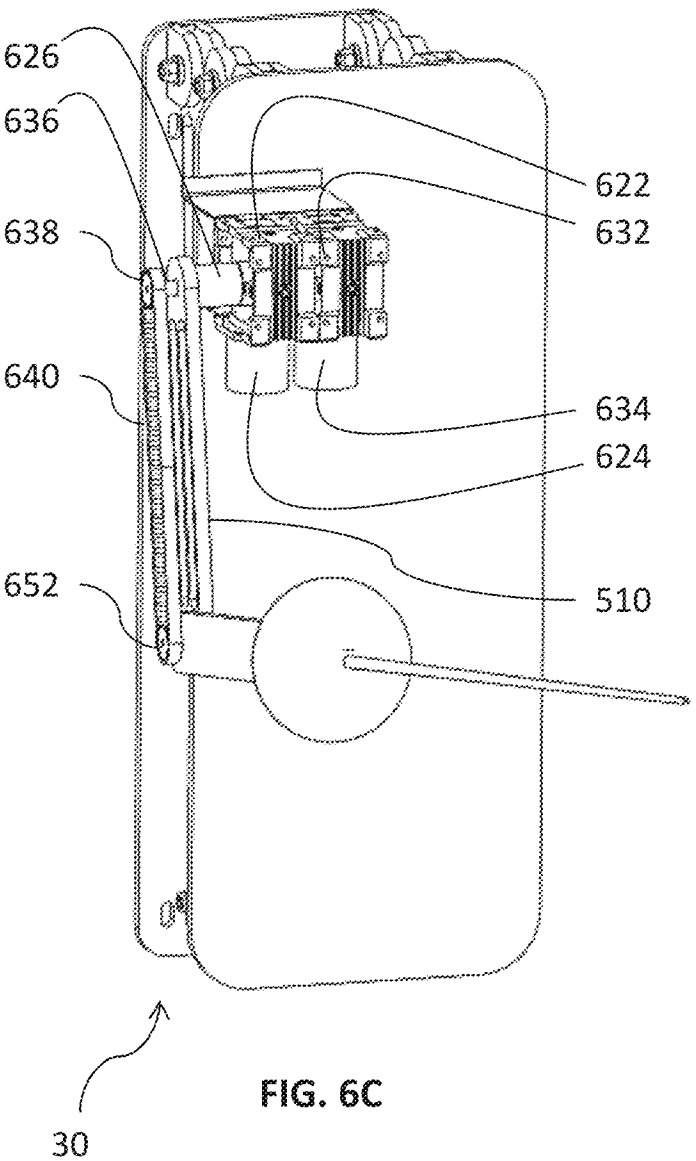
FIG. 6C is front isometric view of training apparatus 30, with the shell pieces of the arm removed.

Yet another possible configuration is shown in FIGS. 6A to 6D. FIG. 6A illustrates a training apparatus 30 in an open, extended state. FIG. 6B illustrates the training apparatus 30 in a closed, retracted state. FIG. 6C is a front isometric view of training apparatus 30, with the shell pieces of the arm removed. FIG. 6D is a side view of the apparatus of FIG. 6C. Training apparatus 30 includes all the components of training apparatus 20, with the addition of an electrically automated actuator assembly 600 that is configured to automatically control the movement of the arm 500. Exemplarily, a series of gears, actuated by motors, effects the movements of the arm 500.

According to the instant embodiment, the arm 500 is mechanically coupled to target platform 200 via a bracket 508. Actuator assembly 600 includes a first electrically powered, automated rotational coupling 620 is mounted on bracket 508 and operationally coupled to shoulder portion 510. Rotational coupling 620 exemplarily includes a worm gearbox 622 and a motor 624. Motor 624 actuates the gearbox 622 which causes the rotational motion of a hollow shaft 626 which is operationally coupled to the shoulder portion 510. As such, clockwise rotation of hollow shaft 626 moves shoulder portion 510 downwards (i.e. towards the ground) and anti-clockwise rotation of the worm gearbox moves the shoulder portion 510 upwards (i.e. away from the ground).

Actuator assembly 600 further includes a second electrically powered, automated rotational coupling 630 is mounted on bracket 508 and operationally coupled to forearm portion 550. Exemplarily, rotational coupling 630 includes a worm gearbox 632 and a motor 634. A rotating rod 636 extends from the worm gearbox 632, through the body of worm gearbox 622, through the hollow shaft 626 and into a shoulder cog 638. Shoulder cog 638 is mechanically coupled to a forearm cog 652 via a timing belt 640. The forearm cog 652 is mounted on the forearm portion 550, at the hinge 506 which couples the shoulder portion 510 to the forearm portion 550. Motor 634 actuates worm gearbox 632 which rotates rod 636 clockwise or anti-clockwise. Forearm cog 652 is fixedly coupled to forearm portion 550. When the rod, cogs and timing belt rotate clockwise, the forearm portion moves downwards. When the rod, cogs and timing belt rotate anti-clockwise, the forearm portion 550 moves upwards. Exemplarily, motors 624 and 634 are 36V, 57 mm 133 W Brushless DC Motors. Exemplarily, the worm gearboxes 622 and 632 are nema 23 worm gearboxes.

According to the instant embodiment, as discussed above, the computing component 300 controls the motors 624 and 634 which actuate the gearboxes 622 and 632 respectively, to automatically control the movement of arm 500, in addition to controlling movement of the movement mechanism 100. In all of the embodiments, the purpose of the system is to create movement identical to the movement of a human fencer, at speeds that are identical to those of the fencer in a real bout. One or more additional sensor pads (similar to sensor pad 210, and having the same functionality as described therefore) are optionally operationally coupled to mechanical arm 500.

Figure 7B:
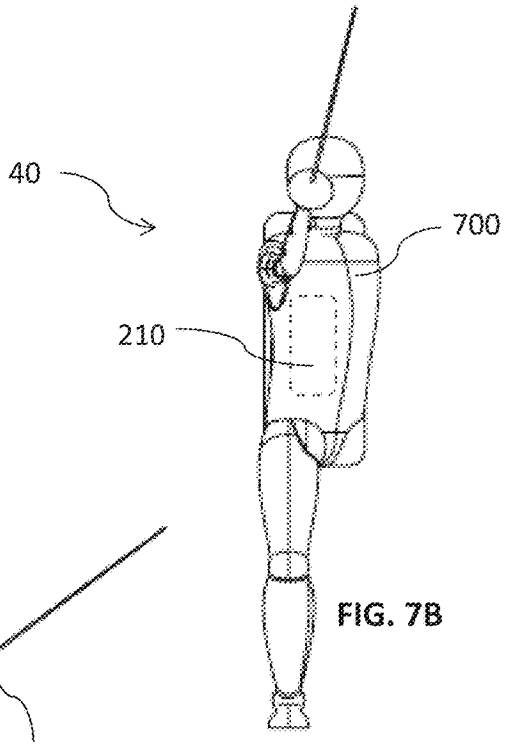
FIG. 7A-C are various views of a training apparatus 40 in the extended state.
Figure 7C:
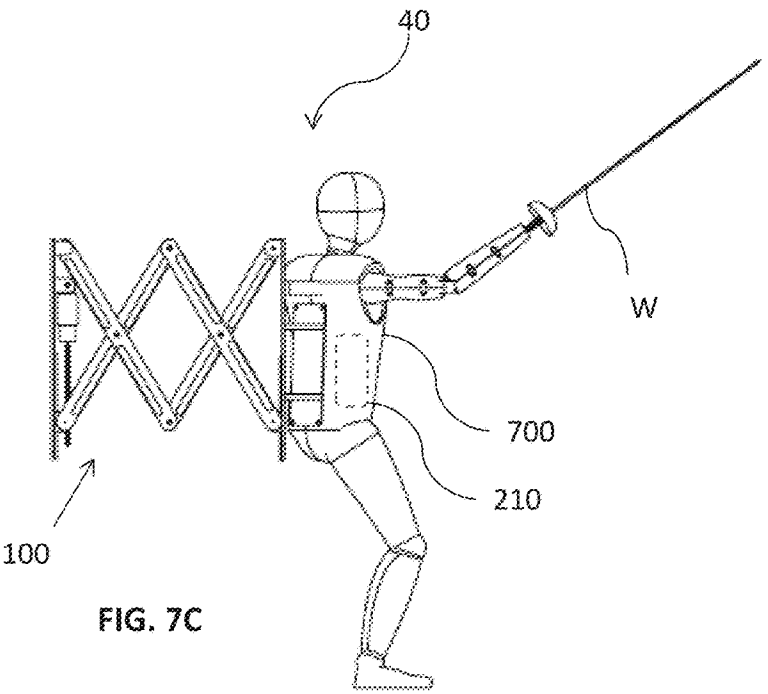
Figure 7A:
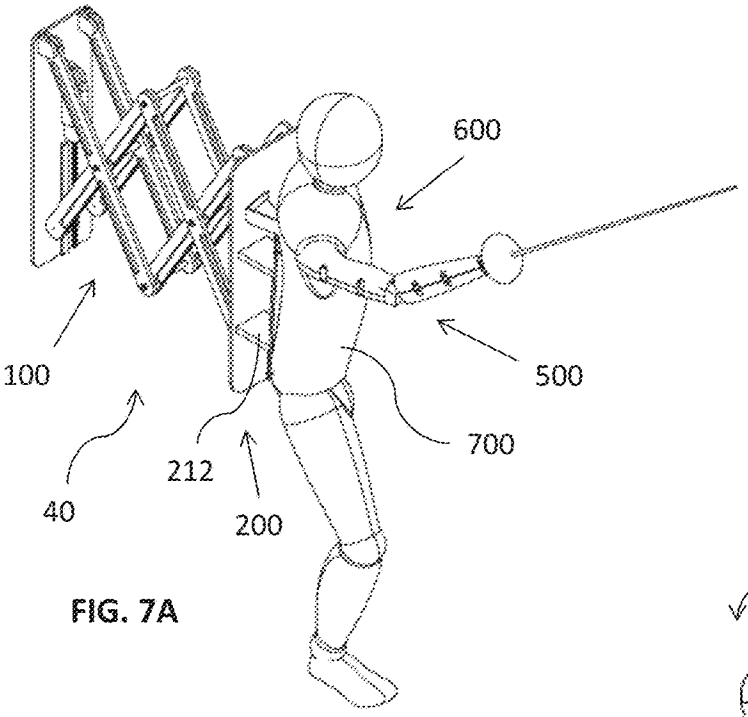

Yet another configuration is shown in FIG. 7A. FIG. 7A is an isometric view of a training apparatus 40 in the extended state. Training apparatus 40 is similar to training apparatus 30 (including all the components as if fully set forth here), with the addition of a partial dummy 700 operationally coupled to the target platform. FIG. 7B is a front view of the same. FIG. 7C is a side view of the same. In the exemplary embodiment depicted in FIGS. 7A-C, dummy 700 (here a partial body with one arm and one leg) is mounted on the target platform 200 via a bracket 212.

The dummy 700 includes a head, a torso, a right arm holding a foil and a right leg. The dummy is a substitute for a sparring partner and presents the same body parts that a sparring partner would present. In an assault or bout, one leg is in front and one leg behind. Therefore, the dummy only includes the "front" leg. Similarly, the fencing arm is active while the non-fencing arm is kept out of the way. The back leg and non-fencing arm are not intentional targets in a bout, even though points are awarded for such touch. Therefore, the dummy only includes the fencing arm. The three disciplines in modern fencing are the foil, the épée, and the sabre. Each weapon has its own rules and strategies. The foil targets the torso, but not the arms or legs. In épée, the entire body is valid target. The sabre is a light cutting and thrusting weapon that targets the entire body above the waist, except the weapon hand.

The dummy 700 preferably includes one or more sensor pads (e.g. sensor pad 210) located in places on the dummy, arm and/or weapon that are considered targets in a fencing bout. Alternatively or additionally, the dummy can be dressed with a lame, which is electronically coupled to computing component 300. The head, torso, arm, foil and leg make the practice more realistic and force the user to take these body parts into account, as one would with a real partner.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A training apparatus for fencing, the training apparatus comprising:

(a) a movement mechanism having an extended state and a retracted state, said movement mechanism adapted to be coupled to a support structure on a first end thereof;

(b) a target platform, said target platform operationally coupled to a second end of said movement mechanism; and (c) a computing component, said computing component electronically coupled to said movement mechanism and configured to control movement of said movement mechanism between said extended state and said retracted state;

wherein said target platform is adapted to move forwards, away from said support structure, until in said extended state, and from said extended state to move backwards towards said support structure until in said retracted state.

2. The training apparatus of claim 1, further comprising:

(d) a mechanical arm operationally coupled to said target platform, said mechanical arm coupled to a weapon.

3. The training apparatus of claim 2, wherein said mechanical arm includes a shoulder portion and a forearm, said shoulder portion rotationally coupled to said target platform and said forearm hingedly coupled to said shoulder portion.

4. The training apparatus of claim 3, wherein said mechanical arm is adapted to be automatically manipulated.

5. The training apparatus of claim 4, wherein said mechanical arm is automatically manipulated by an electrically automated actuator assembly electronically coupled to said computing component, said electrically automated actuator assembly including a series of gears, actuated by motors.

6. The training apparatus of claim 5, further comprising a dummy operationally coupled to said target platform.

7. The training apparatus of claim 6, wherein said dummy includes at least a head, torso and leg.

8. The training apparatus of claim 7, further including at least one additional sensor pad operationally coupled to at least one of said dummy and said mechanical arm, said at least one sensor pad electronically coupled to said computing component.

9. The training apparatus of claim 8, wherein said movement mechanism and said mechanical arm are configured to be remotely programmable and remotely controllable by a remote device in wireless communication with said computing component.

10. The training apparatus of claim 5, wherein said movement mechanism and said mechanical arm are configured to be remotely programmable and remotely controllable by a remote device in wireless communication with said computing component.

11. The training apparatus of claim 3, wherein said mechanical arm is adapted to be manually manipulated.

12. The training apparatus of claim 3, further including sensor pads operationally coupled to said target platform and said mechanical arm, said sensor pads electronically coupled to said computing component.

13. The training apparatus of claim 1, wherein said target platform includes a board and at least one sensor pad mounted on said board.

14. The training apparatus of claim 13, wherein said at least one sensor pad senses a touch by a weapon, said at least one sensor pad electronically coupled to said computing component which is configured to receive sensor values from said at least one sensor pad.

15. The training apparatus of claim 14, wherein said computing component configured to be in wireless communication with a remote device, said remote device including computer-readable instructions for performing statistical computations on said sensor values received from said computing component, and for displaying statistical information on said remote device, said statistical information resulting from said statistical computations.

16. The training apparatus of claim 1, wherein said movement mechanism includes a reversibly extendable member and a linear actuator, said linear actuator effecting movement of said reversibly extendable member between said extended state and said retracted state of said movement mechanism.

17. The training apparatus of claim 16, wherein said reversibly extendable member is a double trellis arrangement.

18. The training apparatus of claim 16, wherein said linear actuator includes a ball screw and motor.

19. The training apparatus of claim 1, wherein movement of said movement mechanism is configured to be remotely programmable and remotely controllable by a remote device in wireless communication with said computing component.

20. A training apparatus for fencing, the training apparatus comprising:

(a) a movement mechanism having an extended state and a retracted state, said movement mechanism adapted to be coupled to a support structure on a first end thereof;

(b) a target platform operationally coupled to a second end of said movement mechanism, said target platform is adapted to move forwards, away from said support structure, until in said extended state, and from said extended state to move backwards towards said support structure until in said retracted state.

* * * * *